US009950488B2

(12) United States Patent
Fritz et al.

(10) Patent No.: US 9,950,488 B2
(45) Date of Patent: Apr. 24, 2018

(54) INTEGRATED VEHICLE GALLEY TRASH COMPACTOR

(71) Applicant: B/E AEROSPACE, INC., Wellington, FL (US)

(72) Inventors: Robert J. Fritz, Glendale, CA (US); Mark P. Rezner, Orange, CA (US); Michael T. Zimmerman, Jr., Laguna Beach, CA (US)

(73) Assignee: B/E Aerospace, Inc., Wellington, FL (US)

( * ) Notice: Subject to any disclaimer, the term of this patent is extended or adjusted under 35 U.S.C. 154(b) by 830 days.

(21) Appl. No.: 14/262,496

(22) Filed: Apr. 25, 2014

(65) Prior Publication Data

US 2014/0230669 A1 Aug. 21, 2014

Related U.S. Application Data

(63) Continuation of application No. 13/009,998, filed on Jan. 20, 2011, now Pat. No. 8,707,864.
(Continued)

(51) Int. Cl.
*B30B 9/30* (2006.01)
*B30B 15/16* (2006.01)
(Continued)

(52) U.S. Cl.
CPC ..... *B30B 9/3007* (2013.01); *B30B 9/3032* (2013.01); *B30B 9/3057* (2013.01);
(Continued)

(58) Field of Classification Search
CPC ... B30B 9/3007; B30B 9/3032; B30B 9/3057; B30B 9/3075; B30B 15/16; B65F 1/10; B65F 1/141
See application file for complete search history.

(56) References Cited

U.S. PATENT DOCUMENTS 3,274,922 A 9/1966 Hefner
3,517,899 A 6/1970 Vernon
(Continued)

FOREIGN PATENT DOCUMENTS

EP 0600808 A1 6/1994
JP 51-079974 U 6/1976
(Continued)

OTHER PUBLICATIONS

Figure A—Galley Workdecks.*

*Primary Examiner* — R. K. Arundale
*Assistant Examiner* — Joseph Finan, Jr.
(74) *Attorney, Agent, or Firm* — Donna P. Suchy

(57) ABSTRACT

A space-saving in-flight trash compactor, comprising a trash chute, a compactor mechanism disposed above a level of the trash chute, and a storage chamber removably positioned below the compactor mechanism and below a level of the trash chute. The storage chamber is vertically aligned with the compactor mechanism. The trash chute is configured to channel trash disposed through an opening of the trash chute at a level of a counter top and above a level of a top of the storage chamber into an opening of the storage chamber at the top of the storage chamber. The opening of the trash chute may be horizontally offset from the vertical alignment of the storage chamber and compactor mechanism.

9 Claims, 8 Drawing Sheets

Related U.S. Application Data

(60) Provisional application No. 61/297,162, filed on Jan. 21, 2010.

(51) Int. Cl.
*B65F 1/10* (2006.01)
*B65F 1/14* (2006.01)
*A47B 77/08* (2006.01)

(52) U.S. Cl.
CPC ..... *B30B 9/3075* (2013.01); *B30B 15/16* (2013.01); *B65F 1/10* (2013.01); *B65F 1/141* (2013.01); *B65F 1/1405* (2013.01); *B65F 1/1431* (2013.01); *A47B 77/08* (2013.01)

(56) References Cited

U.S. PATENT DOCUMENTS 3,563,168 A 2/1971 Doninger
3,659,427 A 5/1972 Harza
3,731,616 A 5/1973 Ligh
3,734,006 A 5/1973 Hennells
3,866,861 A * 2/1975 Ratcliff ..... B64D 11/00 220/908
3,908,538 A * 9/1975 Boyd ..... B30B 9/3078 100/137
3,943,843 A * 3/1976 Steinberg ..... B30B 9/30 100/51
D244,276 S 5/1977 Bachmann
4,022,123 A 5/1977 Bachmann
4,055,317 A 10/1977 Greiss
4,499,407 A * 2/1985 MaCleod ..... G11B 19/2009 310/156.26
4,548,132 A 10/1985 Moon
4,559,870 A * 12/1985 Krummacher ..... B30B 9/30 100/215
4,620,479 A 11/1986 Diamond et al.
4,700,623 A * 10/1987 Durbin ..... B30B 1/36 100/100
5,218,900 A 6/1993 Elliott
5,257,577 A 11/1993 Clark
5,490,455 A 2/1996 Conti et al.
5,619,915 A 4/1997 Wagner et al.
5,690,025 A 11/1997 Hawkins
5,960,710 A 10/1999 Holtom
6,367,377 B1 4/2002 Gawley et al.
7,096,780 B1 8/2006 Hawkins
7,481,160 B1 1/2009 Simon et al.
2002/0108507 A1 * 8/2002 May ..... B30B 9/3007 100/45
2005/0040939 A1 2/2005 Jobes et al.
2006/0186268 A1 * 8/2006 Harrington ..... B64D 11/0007 244/118.5
2008/0246334 A1 10/2008 Drescher
2010/0307350 A1 * 12/2010 Cunningham ..... B30B 9/301 100/35
2011/0283900 A1 11/2011 Fritz et al.
2012/0137902 A1 6/2012 Cunningham et al.

FOREIGN PATENT DOCUMENTS

JP 06-016205 A 1/1994
JP 2003-275046 A 9/2003

* cited by examiner

INTEGRATED VEHICLE GALLEY TRASH COMPACTOR

CROSS-REFERENCE TO RELATED PATENT APPLICATIONS

This patent application is a continuation of U.S. patent application Ser. No. 13/009,998 filed Jan. 20, 2011 and issued as U.S. Pat. No. 8,707,864 on Apr. 29, 2014, and which claims the priority benefit of U.S. Provisional Application No. 61/297,162 filed Jan. 21, 2010, both of which are incorporated by reference herein in their entirety.

BACKGROUND

Embodiments generally relate to trash compactors. Specifically, embodiments relate to trash compactors for use in vehicles such as an aircraft.

Often, commercial or private aircraft provide passengers and crew a galley or kitchen for food preparation and cleanup. Because of the limited physical space available for use on an aircraft, relatively little physical space may be allocated for use as a galley. Any galley equipment for food preparation or disposal must be designed to economize on the amount of space and weight used. In addition, such food preparation or disposal equipment must be safe and secure during operation in-flight.

Conventional aircraft trash compactors tend to use a large amount of space under the counter within the galley, thereby reducing the total volume of space available for stored food, or for devices for food storage, preparation or disposal.

SUMMARY

An embodiment includes a space-saving in-flight trash compactor, that may include a compactor mechanism and a storage chamber, which are adapted for easy positioning within an otherwise unused (or "dead") space in an aircraft galley. In an embodiment, either or both of the compactor mechanism and storage chamber are rotatably attached to an axle positioned below a compactor mechanism and a trash chute for swiveling around the axle to permit ease of access while removing trash from the storage chamber. In accordance with various embodiments of the invention, and as shown in FIG. 5, only a single trolley or cart 441 (typically, with width of approximately twelve inches) needs to be removed from the space adjacent to the dead space in the aircraft galley for emptying the storage chamber. Optionally, the compactor mechanism is mounted to either the same or a separate axle, permitting ease of access to the compactor mechanism during maintenance.

In some embodiments, the storage chamber is mounted on castors alone without also being rotatably attached to an axle. In still other embodiments, the storage chamber is secured to a load-bearing plate. The load-bearing plate, in turn, is slidably attached to rails that permit an easy range of motion between operating and trash removal positions. In embodiments in which the storage chamber is secured to a load-bearing plate, an actuator or actuators may be used to aid in moving the storage chamber between operating and trash removal positions.

To permit trash to be deposited from above, a trash chute and a chute interface may be formed into the storage chamber. Trash deposited in the chute is channeled by the chute to the chute interface, and by the chute interface into the main portion of the storage chamber. Optionally, the trash chute includes a flap or covering either at an end closest to the storage chamber or an end further away from the storage chamber.

Optionally, the storage chamber may also be attached to rotatable supports, such as castors or wheels. Such rotatable supports provide additional physical support to the storage chamber, especially during operation of the compactor, and do not interfere with the rotation of the storage chamber around the axle to which the storage chamber is rotatably attached.

The storage chamber optionally includes also one or more latches for securing the storage chamber in one or more positions. For example, a latch may be installed on the storage chamber to secure the storage chamber during operation of the compactor.

The trash compactor may be operated by direct or remote control. A remote control may be provided, for example, in a different physical location within the galley or even in a different crew area of the cabin. Optionally, the invention may be operated semi-automatically through use of a trash level sensor within the storage chamber in communication with the compactor mechanism.

According to an embodiment, there is provided a method for storing and compacting trash while in-flight, the method comprising the steps of: moving a storage chamber into a chamber operating position; securing the storage chamber in the chamber operating position; executing a compaction cycle; and removing the storage chamber into a chamber maintenance position.

An embodiment of a trash compaction system comprises: a trash chute; a compactor mechanism disposed above a level of the trash chute; and a storage chamber removably positioned below the compactor mechanism and below a level of the trash chute. The storage chamber may be vertically aligned with the compactor mechanism. The trash chute may be configured to channel trash disposed through an opening of the trash chute at a level of a counter top and above a level of a top of the storage chamber into an opening of the storage chamber at the top of the storage chamber. The opening of the trash chute may be horizontally offset from the vertical alignment of the storage chamber and compactor mechanism.

The trash compaction system may include an electronic system controller that controls operation of the compactor mechanism, and a user interface which interfaces with the electronic system controller to initiate a compaction cycle upon a command input from an operator.

The storage chamber may include a weight sensor communicatively coupled with the electronic system controller, and the electronic system controller may activate operation of the compactor mechanism according to a weight reading of the weight sensor exceeding a threshold value.

The storage chamber may include a pressure sensor communicatively coupled with the electronic system controller, and the electronic system controller may deactivate operation of the compactor mechanism according to a pressure reading of the pressure sensor exceeding a threshold value.

The electronic system controller may include a communications network interface, and the electronic system controller may initiate a compaction cycle in response to a command received over the communications network interface.

The storage chamber may have a generally cylindrical shape oriented in a vertical direction.

The compactor mechanism may comprise a hydraulic system including a hydraulic pump, a hydraulic reservoir, and a compactor actuator hydraulically driven to compact trash within the storage chamber.

The compactor actuator may be constructed of aircraft alloy steel.

The compactor actuator may include a curved lower surface sloped upward from an outer edge toward a center.

The hydraulic pump may include a brushless DC motor.

An embodiment of a method for compacting trash includes depositing trash through a trash chute into a storage chamber positioned below a level of the trash chute such that the trash chute channels the trash at least partially along a horizontal direction between an opening of the trash chute and an opening at a top of the storage chamber. The method also includes controlling a compactor mechanism to initiate a compaction cycle, and executing the compaction cycle in which a compactor actuator vertically aligned with the storage chamber extends from a position above a level of the trash chute into the storage chamber through the opening at the top of the storage chamber to a level below the trash chute and compacts the trash. The method further includes ending the compaction cycle in which the compactor actuator retracts from the storage chamber into the position above the level of the trash chute, and emptying the storage chamber by moving the storage chamber out from under the compactor mechanism, removing the compacted trash from the storage chamber, and replacing the storage chamber in position in vertical alignment under the compactor mechanism.

Controlling the compactor mechanism to initiate the compaction cycle may include entering a command input to an electronic system controller that controls operation of the compactor mechanism at a user interface.

Controlling the compactor mechanism to initiate the compaction cycle may include an electronic system controller activating operation of the compactor mechanism according to a weight reading received from a weight sensor of the storage chamber.

Ending the compaction cycle may include an electronic system controller deactivating operation of the compactor mechanism according to a pressure reading received from a pressure sensor of the storage chamber.

Controlling the compactor mechanism to initiate the compaction cycle may include an electronic system controller that controls operation of the compactor mechanism receiving a command over a communications network interface.

Executing the compaction cycle may include operating a hydraulic pump to hydraulically drive the compactor actuator.

Another embodiment of a trash compaction system includes a trash chute and a compactor mechanism disposed above a level of the trash chute. The system also includes a generally cylindrical storage chamber removably positioned below the compactor mechanism and below a level of the trash chute. The storage chamber is vertically aligned with the compactor mechanism. The trash chute is configured to channel trash disposed through an opening of the trash chute at a level of a counter top and above a level of a top of the storage chamber into an opening of the storage chamber at the top of the storage chamber. The system also includes an electronic system controller that controls operation of the compactor mechanism, and a user interface which interfaces with the electronic system controller to initiate a compaction cycle upon a command input from an operator.

The compactor mechanism may include a hydraulic system including a hydraulic pump, a hydraulic reservoir, and a compactor actuator hydraulically driven to compact trash within the storage chamber.

The storage chamber may include a weight sensor communicatively coupled with the electronic system controller, and the electronic system controller may activate operation of the compactor mechanism according to a weight reading of the weight sensor exceeding a threshold value.

The storage chamber may include a pressure sensor communicatively coupled with the electronic system controller, and the electronic system controller may deactivate operation of the compactor mechanism according to a pressure reading of the pressure sensor exceeding a threshold value.

DETAILED DESCRIPTION

Figure 1:
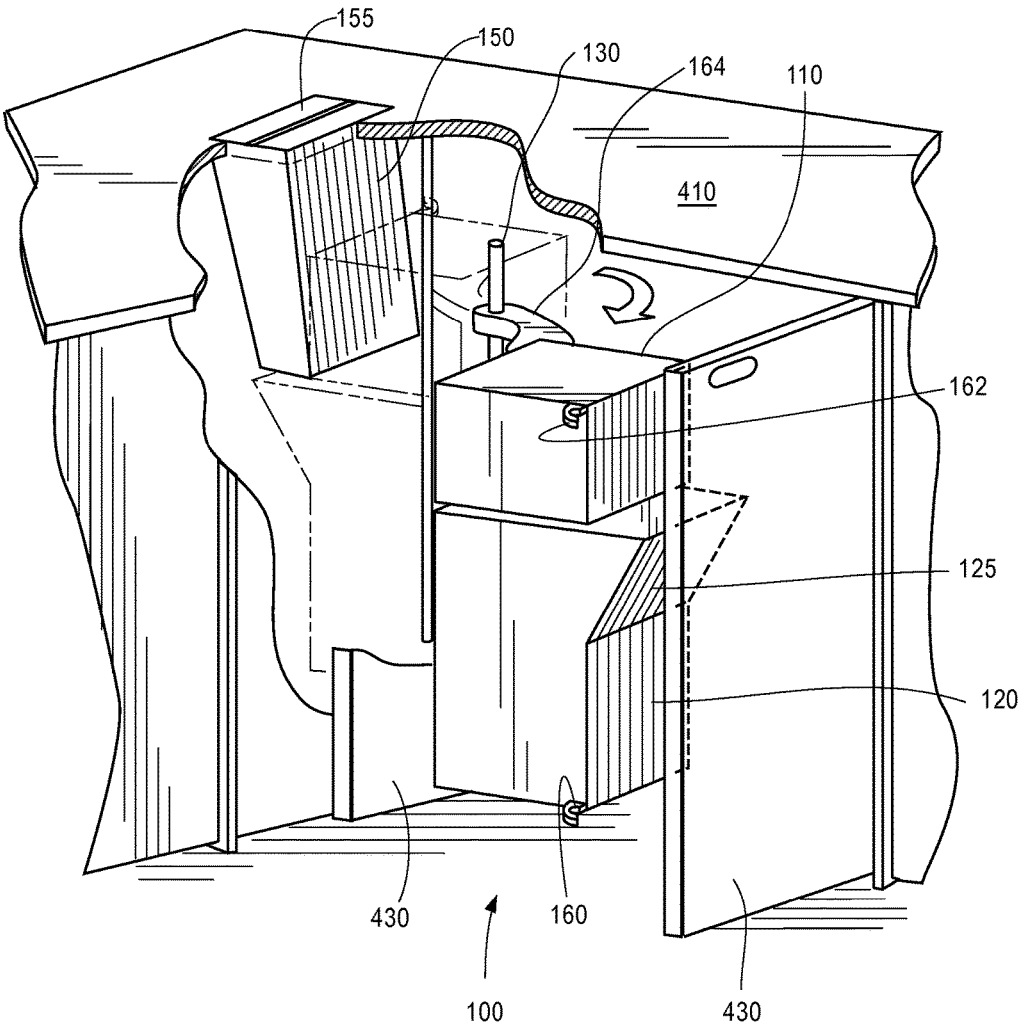
FIG. 1 shows a space-saving in-flight trash compactor rotated into a position for maintenance or trash removal, in accordance with an embodiment.

The following examples further illustrate various embodiments. Referring to FIG. 1, there is shown an embodiment of the space-saving in-flight trash compactor 100 in which the storage chamber 120 and compactor mechanism 110 have been rotated around at least one axle 130 into a position for maintenance and/or removal of trash from the storage chamber.

As shown in the embodiment of FIG. 1, the trash compactor may be generally disposed underneath a workdeck 410. Under-workdeck doors 430 are shown open, permitting rotation of compactor mechanism 110 and storage chamber 120 into positions no longer underneath workdeck 410. As shown in the alternative embodiment of FIG. 5, the workdeck 410 may also cover trolleys or carts 441, 442, and 443 without workdeck doors 430.

Several additional aspects of the features are illustrated in FIG. 1. Storage chamber 120 further comprises a chute interface 125 formed into the body of the storage chamber 120. The chute interface 125 is adapted to channel trash received from the trash chute 150 when the compactor is in a position for operation. The chute interface 125 need not take the generally lip-shaped form shown in FIG. 1, but rather may be adapted to a different shape as necessary to interface with a trash chute 150. Moreover, the trash chute 150 may take a different shape, such as a cylindrical or elliptical shape.

In other embodiments, storage chamber 120 does not include a chute interface 125. In such embodiments, the chute 150 channels trash directly into the storage chamber 120. In accordance with such embodiments, the chute 150 is designed with flaps in addition to flaps 155 for pressing trash into storage chamber 120 before a compaction cycle. In accordance with such embodiments, the chute 150 is designed to slide or collapse toward the storage chamber 120 to secure any trash in the storage chamber 120 before a compaction cycle.

Figure 5:
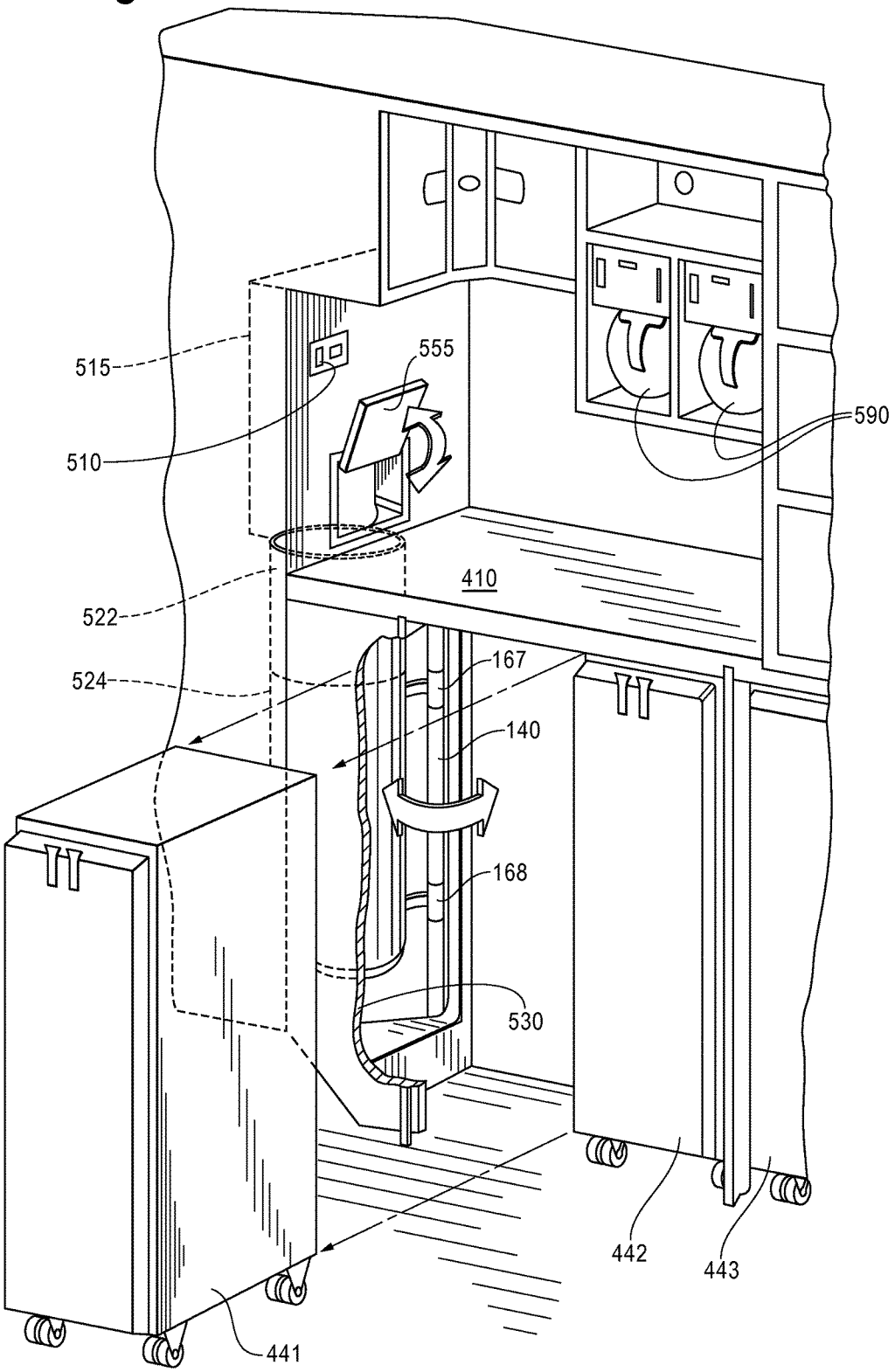
FIG. 5 shows a perspective view of an alternative embodiment comprising a side-loading chute.

In still other embodiments, neither a chute interface 125 nor a chute 150 are required. FIG. 5 shows such an embodiment. Trash is loaded after flipping up a side-loading flap 555 into a space directly above cylindrical storage chamber 524. A compactor mechanism 515 is disposed above the cylindrical storage chamber 524. The user interface 510 shown in FIG. 5 is used to start a compaction cycle. The user interface 510 may incorporate programmable logic or wireless components that permit for a delayed start of the compaction cycle, or remote activation.

Referring again to FIG. 1, latches 160 and 162 are shown. Latches 160 and 162 secure the compactor mechanism 110 and storage chamber 120 in position during operation. Latches may also be used to secure chute flaps 155 or 555 into place during takeoff and landing.

Figure 2:
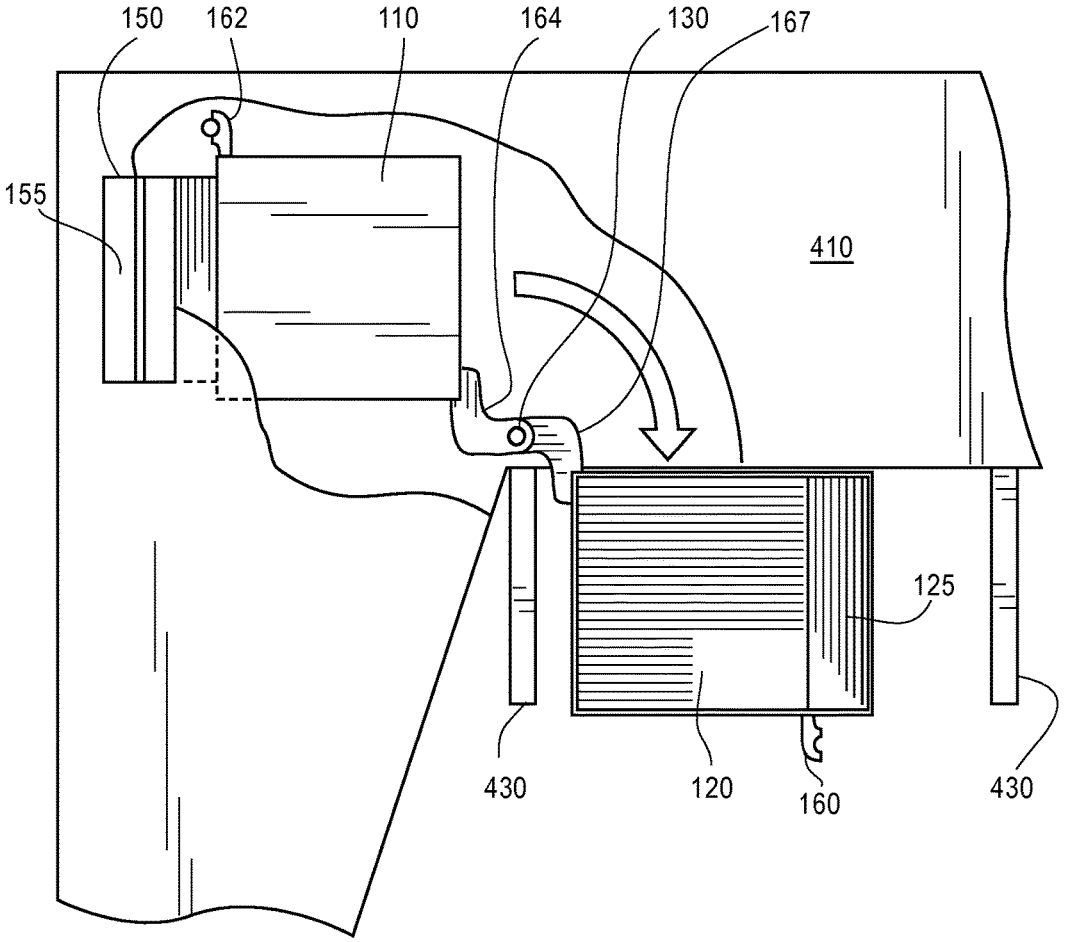
FIG. 2 shows a top view of the rotation of a compactor mechanism and storage chamber, in accordance with an embodiment.

As illustrated, the embodiment of FIG. 1 uses "dead space" otherwise inaccessible to galley devices. In several embodiments, this benefit is achieved through rotatable attachment of either or both of the compaction mechanism 110 and the storage chamber 120 to one or more axles 130 and 140 (not shown in FIG. 1). As shown in an embodiment in FIG. 2, the storage chamber 120 is rotatably attached to axle 140 by hinge 164. The storage chamber 120 is thus capable of swiveling or pivoting around axis 140. In the embodiment shown in FIG. 2, the storage chamber 120 has rotated 180 degrees around axle 140 into a maintenance or trash removal position. As shown in FIG. 2, when the storage chamber is in an operating position (indicated by dashed lines), the chute interface 125 is positioned directly below the trash chute 150 and chute flaps 155. Chute flaps 155 are provided to prevent trash from exiting the storage chamber suddenly during compaction. In the embodiment shown in FIG. 1, two chute flaps 155 are shown. In another embodiment, such as that shown in FIG. 5, a single flap 555 may be used.

Figure 3:
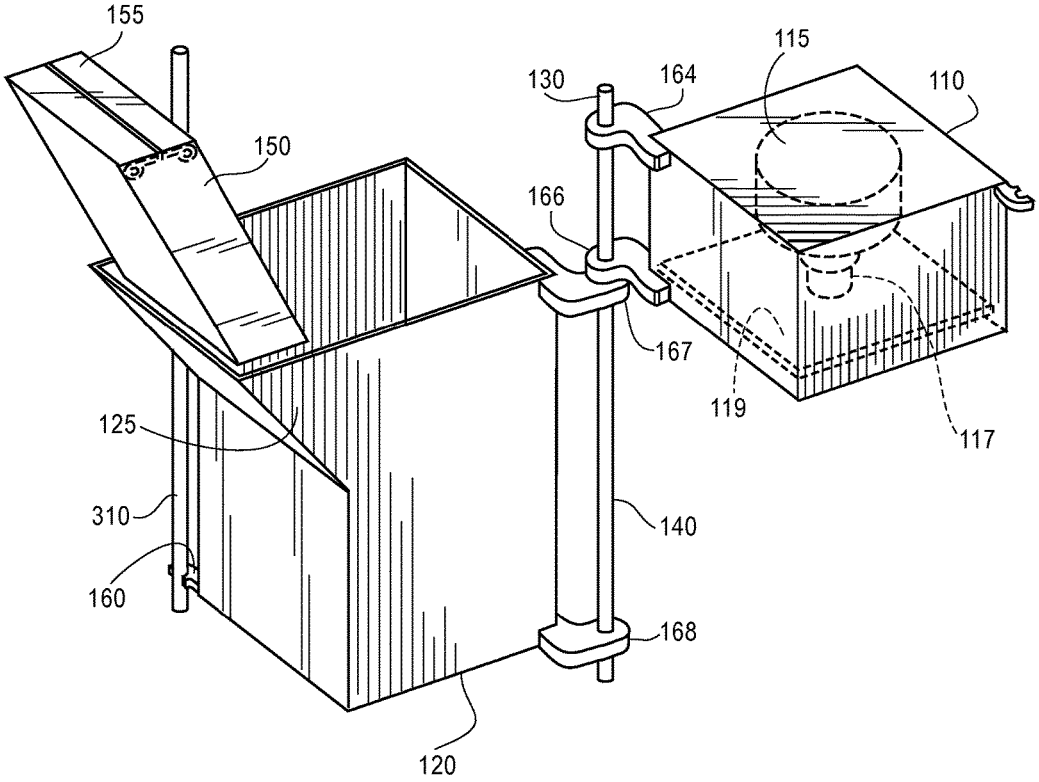
FIG. 3 shows a perspective view of a trash chute, chute interface, storage chamber, and compactor mechanism, in accordance with an embodiment.

FIG. 3 illustrates an embodiment in which the compactor mechanism 110 has been rotated into a maintenance position. The compactor mechanism 110 generally includes an actuator 115, drive shaft 117, and compaction plate 119. The actuator 115 may be any actuator suitable for use with aircraft power (including both fixed and wild frequency AC power) that provides sufficient force for compaction. For example, a hydraulic pump, discharge pump, or other pump-driven mechanical actuator may be used as a mechanism for generating force behind the compaction plate 119. Compaction plate 119 is adapted to press trash downwardly into the storage chamber 120 during operation.

In the embodiment of FIG. 3 the compactor mechanism 110 is mounted to an upper axle 130 and the storage chamber 120 is mounted to a lower axle 140. Hinges 164 and 166, 167 and 168 provide rotatable attachments to the upper and lower axles, respectively. In another embodiment, the compactor mechanism 110 and storage chamber 120 may be mounted to the same axle.

FIG. 3 also shows a rail 310 against which the base of the operating chamber remains flush during operation. In an embodiment, latch 160 is adapted to engage the rail 310 to secure the storage chamber 120 in position during operation.

In the embodiments shown in FIGS. 1-4, the storage chamber 120 has a rectangular footprint with a lip for the chute interface 125. In other embodiments not shown, the storage chamber 120 does not include a chute interface 125. In still other embodiments, such as that shown in FIG. 5, the cylindrical storage chamber 524 is disposed below a cylindrical chute 522, with the diameter of the chamber 524 and chute 522 being equal. The storage chamber 120 need not have a generally rectangular footprint as shown, and may have a circular, elliptical, or other footprint.

In addition, in some embodiments, the storage chamber 120 is not mounted to a lower axle 140. In such embodiments, the storage chamber may be movable in and out of operating position with castors alone, or with castors mounted to a load-bearing plate on which the storage chamber 120 rests. In other embodiments, the storage chamber may be secured to a load-bearing plate (not shown) mounted on rails for easy positioning of the storage chamber by crew. In such embodiments, one or more actuators may assist in positioning the storage chamber 120.

During long-range flights, a flight attendant may easily access the storage chamber one or more times during the flight for changing of liners as necessary.

Figure 4A:
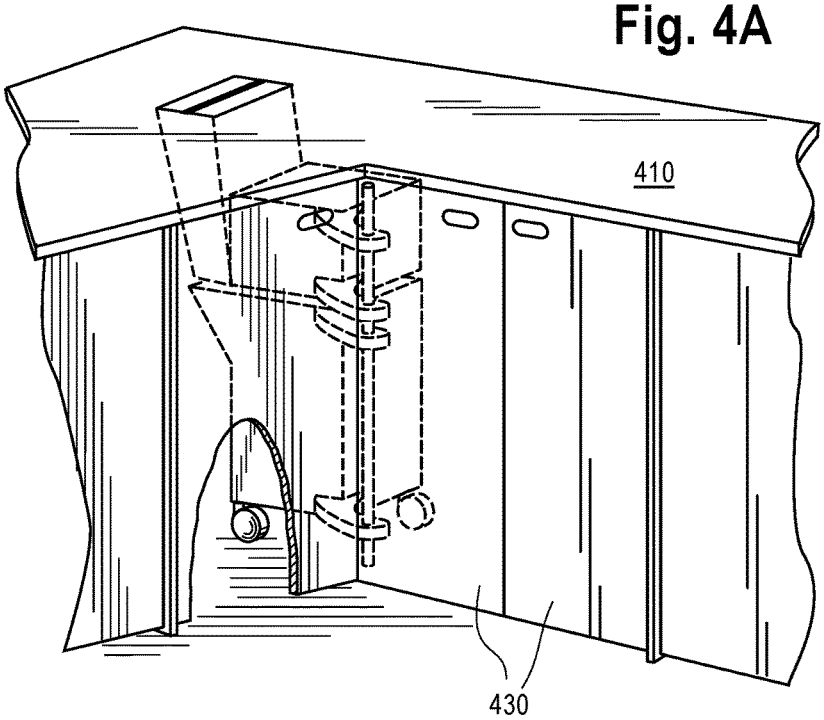
FIGS. 4A and 4B show left and right configurations for left and right sides of an aircraft, in accordance with an embodiment.
Figure 4B:
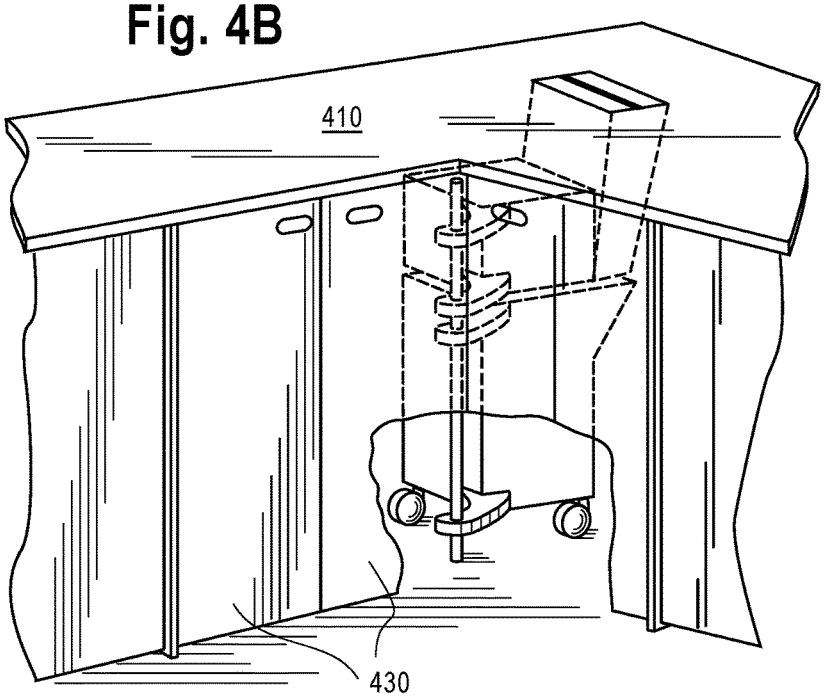

As illustrated in FIG. 4A, in an embodiment, the storage chamber 120 may be supported by castors which roll on the floor as the storage chamber is pivoted on the axle 140. In such an embodiment, the storage chamber 120 may be detachable from the axle 140 so that the storage chamber 120 may be rolled out from under the workdeck to provide easier access when changing liners. In addition, the castors may provide additional support if the storage chamber becomes heavy after it approaches capacity after several cycles of compaction. FIGS. 4A and 4B also illustrate right-hand and left-hand configurations of the trash compactor installed in right-hand and left-hand symmetric aircraft galley configurations.

FIG. 5 shows another embodiment of the trash compactor comprising a side-loading chute flap 555, which permits trash to be dropped directly into cylindrical storage chamber 524. FIG. 5 also shows the workdeck 410, and two coffee makers 590 installed above the workdeck 410. The leftmost trolley or cart 441 can be rolled out to permit the cylindrical storage chamber 524 to swivel out into a maintenance position, thereby permitting trash removal. Shown for illustrative purposes only are coffee pots 590, which might be installed in an aircraft galley.

A cutaway 530 in FIG. 5 shows in the interior of the space below workdeck 410. As shown in FIG. 5, the cylindrical storage chamber 524 is rotatably attached to axle 140 by hinges 167 and 168. After a compaction cycle, a trolley or cart 441 is rolled out from underneath workdeck 410 to permit the cyclindrical storage chamber 524 to be emptied.

To begin a compaction cycle, several different mechanisms are used in various embodiments. In one embodiment, a locking mechanism on the trash chute door triggers the compaction cycle. In another embodiment, the compaction cycle is initiated from a dedicated remotely located panel that also contains a display device for indicating equipment status (operational, in-op, trash level, diagnostics, servicing, etc.). In still another embodiment, the compaction cycle is triggered from a central galley control interface that serves multiple functions, one of which is the TC mode which handles TC operation/status/diagnostics/servicing functions. In all cases, safety interlocks may be required before a compaction cycle begins.

Figure 6:
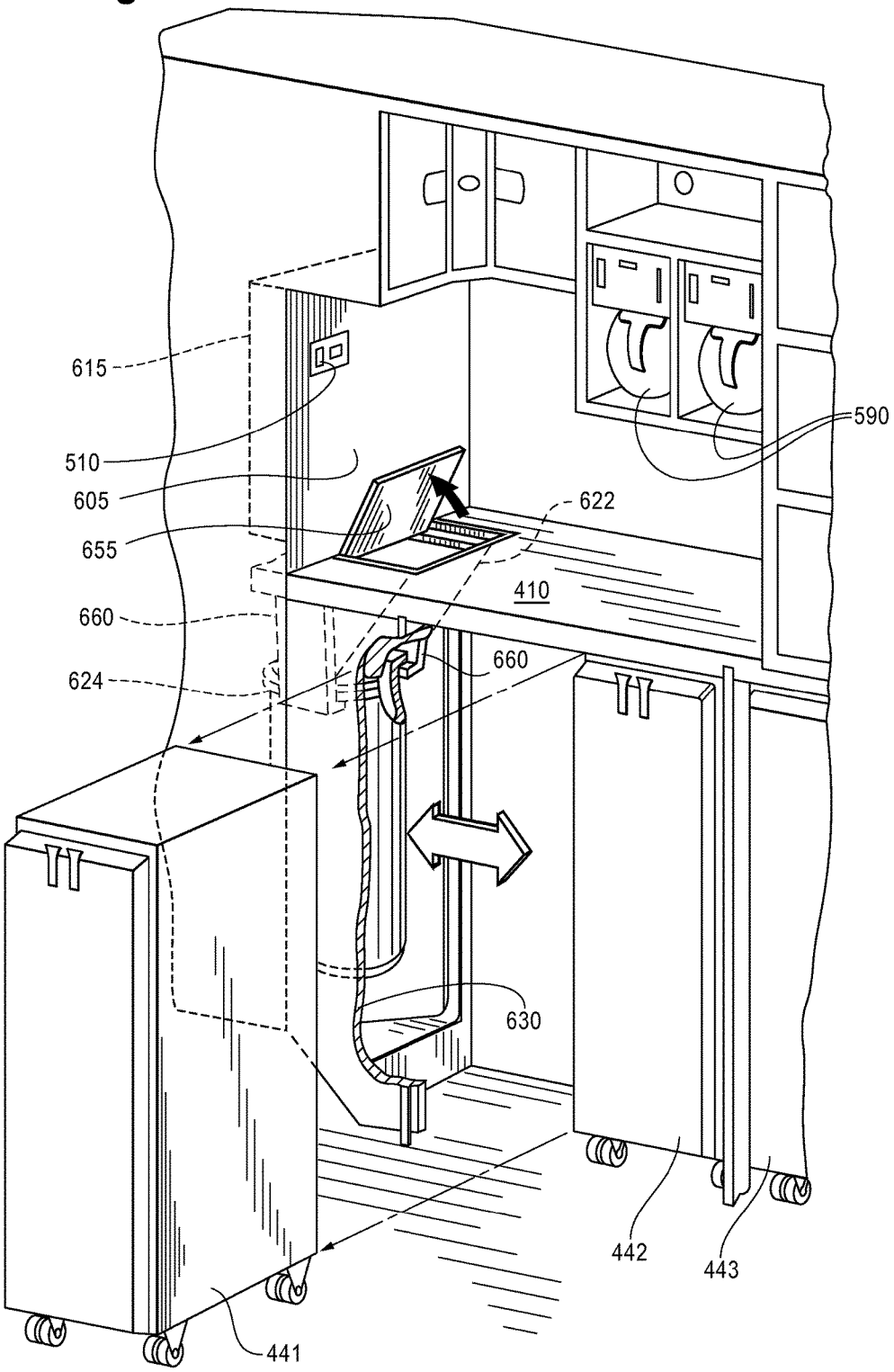
FIG. 6 shows a perspective view of another alternative embodiment comprising an angled top-loading chute and a cylindrical storage chamber.

FIG. 6 shows a perspective view of another alternative embodiment comprising an angled top-loading chute 622 and a cylindrical storage chamber 624. The embodiment illustrated in FIG. 6 is similar to that illustrated in FIG. 5, except as described below. An opening at the top of the angled top-loading chute 622 is covered by a hinged chute lid 655 in the workdeck 410. The angled top-loading chute 622 guides trash dropped through the opening in the workdeck 410 into a cylindrical storage chamber 624 below a level and to one side of the opening of the workdeck 410. The hinged chute lid 655 may include a latch, such as a solenoid-activated and/or a manually activated latch, and a lid open sensor. The trash compaction system may not perform a compaction cycle while the chute lid 655 is open for safety purposes, and may include a safety interlock to prevent compaction from occurring when the chute lid 655 is opened.

The user interface 510 may be installed in a wall panel 605 behind which a compactor mechanism 615 is disposed, and above an area where the chute lid 655 is disposed in the workdeck 410. The user interface 510 may also include a panel and a bezel and be integrated with galley inserts which provide a common style interface in the galley.

A cutaway 630 in FIG. 6 shows the interior of the space below workdeck 410. The cylindrical storage chamber 624 is secured under the workdeck 410, a bottom of the angled top-loading chute 622, and the compactor mechanism 615 by a support assembly 660. The support assembly may include one, two, or more hanging support brackets that form a collar around a top lip of the cylindrical storage chamber 624. As illustrated by a cutaway at a top right of the cylindrical storage chamber 624, the lip at the top of the cylindrical storage chamber 624 is secured in place by a protrusion of the bottom of the support assembly 660. The support assembly 660 may collectively be considered a collar that encircles, at least partially, the lip at the top of the cylindrical storage chamber 624. In various embodiments, the cylindrical storage chamber 624 may be secured in place using support assembly 660 or other mechanisms such as those described elsewhere herein.

The leftmost trolley or cart 441 may be rolled out to permit the cylindrical storage chamber 624 to be manually pulled out in a horizontal direction, thereby permitting trash removal after a compaction cycle. In various embodiments, a space within which the cylindrical storage chamber 624 is situated, such as a corner space within a galley, may be otherwise inaccessible from a front or side of the galley in which the trash compactor system is installed. Thus, access to the cylindrical storage chamber 624 from a side of the space in which the trolley or cart 441 is stored makes efficient use of otherwise inaccessible space in a space-constrained environment such as an aircraft.

The cylindrical storage chamber 624 may be lined by a consumable trash container, or trash liner, which may be a heavy-duty polyethylene bag which is form-fitted to the cylindrical storage chamber 624. The consumable trash container may have high tensile strength to withstand tearing forces and prevent ruptures, while also being disposable, recyclable, and easy to install and remove.

Figure 7:
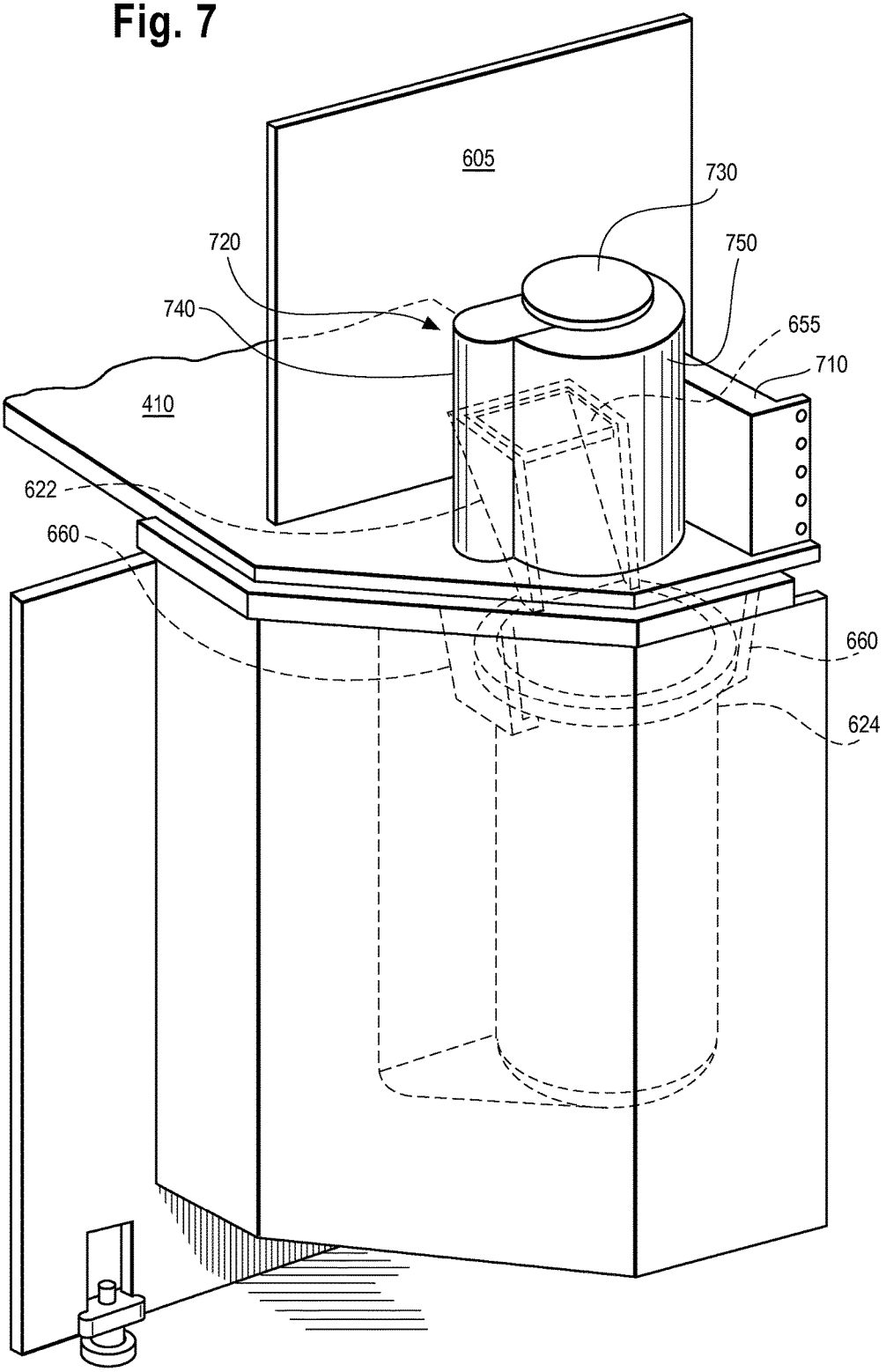
FIG. 7 shows a compactor mechanism, in accordance with an embodiment.

FIG. 7 shows a compactor mechanism, in accordance with an embodiment. The compactor mechanism of FIG. 7 may be an embodiment of compactor mechanism 515 of FIG. 5 and/or compactor mechanism 615 of FIG. 6. The operational components of the compactor mechanism of FIG. 7 are disposed behind the wall panel 605 above the level of the workdeck 410, relative to an accessible side of the galley in which the compactor mechanism is installed. Thus, the operational components of the compactor mechanism of FIG. 7 are generally inaccessible to cabin attendants during normal operation and not occupying valuable space on the workdeck 410 or in a space where a trolley or galley cart (e.g., 441, 442, 443) may be stored. Because the operational components of the compactor mechanism are disposed above the level of the workdeck 410, the capacity of the cylindrical storage chamber 524 or 624 may be larger than that of embodiments where the compactor mechanism is located below the level of the workdeck 410. In addition, the installation of the operational components of the compactor mechanism above the level of the workdeck 410 provides better access to facilitate emptying of trash from the cylindrical storage chamber 524 or 624 and provides a short distance from the counter-level trash chute access to the top of the cylindrical storage chamber 524 or 624, which reduces trash jamming conditions.

The illustrated operational components include an E-box LRU 710 and a hydraulic system LRU 720. The E-Box LRU 710 includes an electronic system controller for the trash compactor, such as the trash compactors of FIGS. 6 and 7. The E-Box LRU 710 may interface with the user interface 510 to control the hydraulic system LRU 720. The electronic system controller of the E-box LRU 710 may include a microprocessor-driven control system, fuse protection, electro-magnetic interference (EMI) protection, a power converter transformer, and an external sensor array.

The hydraulic system LRU 720 may include a hydraulic pump motor, motor driver electronics, hydraulic manifold, support assembly (collar), four-way control valve, pressure transducer, pressure relief valve, fluid filter, ram sensor, and fluid level sensor. As illustrated, the hydraulic system LRU 720 includes a compactor actuator 730, a pump assembly 740 including a hydraulic pump, and a hydraulic fluid reservoir 750. The actuator 730 is disposed above the cylindrical storage chamber 524 or 624 into which trash is inserted via the cylindrical chute 522 or the angled top-loading chute 622, respectively. The actuator 730 compacts the trash inserted into the cylindrical storage chamber 524 or 624.

The hydraulic pump motor of the hydraulic system LRU 720 provides power to compact the trash using the actuator 730. The motor may drive a hydraulic pump within the pump assembly 740 which pumps fluid from the hydraulic fluid reservoir 750 to the actuator 730. The actuator 730 may be, e.g., a three- or multi-stage telescopic actuator. System pressure may be monitored by the system controller of the E-box LRU 710 through a pressure transducer.

The hydraulic actuator 730 may be made of, e.g., aircraft alloy steel. The three-stage cylinders and seals may be designed to meet a fatigue life of at least one million cycles as well as required burst pressures. This high-strength design may enable the actuator 730 to reach high compression force on a continual basis without sacrificing a gross weight penalty. The actuator 730 may have an essentially flat lower surface. Alternatively, the actuator 730 may have a curved lower surface that presses down onto the trash such that the trash is directed more toward the center than the sides of the cylindrical storage chamber 524 or 624. In other words, the lower surface of the actuator may be sloped upward from the outer edges to the center. By directing trash more toward the center than the sides of the cylindrical storage chamber 524 or 624, load balance may be improved, the compacted trash may be less likely to jam during operation of the trash compactor, and the compacted trash may be more easily removed from the cylindrical storage chamber 524 or 624 after compaction.

The motor used in the hydraulic system LRU 720 may be a brushless DC motor designed to start smoothly under load and operate at any speed without sacrificing efficiency. The system controller of the E-box LRU 710 may monitor power consumption and maximize the motor speed at all times in order to meet predefined (e.g., 1000 W) power consumption requirements and minimize the compaction cycle duration as a convenience to the operator. The pump of the pump assembly 740 may also be designed to provide high pressure at low motor speed where the load is highest.

Operation of the trash compactor system may be via a locally mounted user interface 510, providing push button operation, lamp indications and text messages, as well as any other user input and output. The user interface 510 may include a wire harness which connects the user interface 510 to the E-box LRU 710. The user interface 510 may provide information as to the status of the trash compactor system, such as how many compaction cycles have been performed since the compacted trash was last collected, how much compacted and/or uncompacted trash is stored within the cylindrical storage chamber 524 or 624, and the like. The user interface 510 may also provide controls by which a cabin crew member may open the flap 555 or chute lid 655, close the flap 555 or chute lid 655, activate a trash compaction cycle, or perform other functions such as maintenance and tests. Operation of the trash compactor system via the user interface 510 may be simple and intuitive and harmonize with operation of other systems onboard the aircraft.

The trash compactor system may also be operated via remote control. The trash compactor system preferably integrates with the aircraft's galley system via a Controller Area Network (CAN) bus interface (galley data bus) to a galley network controller (GNC). The GNC preferably handles all network communications and arbitrates cooperative power control among a group of equipment in the galley (galley group).

The generally cylindrical design of the cylindrical storage chamber 524 or 624 facilitates much higher compacting pressures than that of a conventional rectangular box design. The compaction pressure for most in-flight trash may be ten times higher in the cylindrical embodiments of the trash compactor system than that of conventional trash compactors. This results in four times more compaction efficiency, when measured against the volume of uncompressed-to-compressed material ratios.

The cylindrical storage chamber 524 or 624 may include a load sensor, a weight sensor, and a structural fail-safe sensor to facilitate the system controller of the E-box LRU 710 to determine when to perform a compaction cycle, how much pressure to apply during a compaction cycle, when to indicate that the compacted trash should be removed from the cylindrical storage chamber 524 or 624, and/or when to issue a warning or error message regarding structural integrity or failure of the cylindrical storage chamber 524 or 624.

Embodiments may further reduce the pressure and frictional forces due to the compacted trash contacting the interior walls of the storage chamber in which the trash is compacted (compaction chamber) by using a cylindrical compaction chamber. For instance, a cylindrical compaction chamber such as the cylindrical storage chamber 524 or 624, which has a circular cross section, is advantageous over conventional compaction chambers which have rectangular cross sections because there are no corners in which compacted trash may become wedged or stuck. Additionally, a cylinder has a smaller side surface area per unit volume than other containers that have square, rectangular, triangular, or other polygonal cross sections, thereby reducing pressure and frictional forces between a side surface of the compacted trash which contacts the interior sidewalls of the compaction chamber. A cylindrical column of compacted trash having a given unit volume of compacted trash has less surface area contacting sidewalls of the cylindrical storage chamber 524 or 624 than a rectangular block of compacted trash having the same unit volume and a same top or bottom surface area in a comparable storage or compaction chamber having a rectangular cross section.

Figure 8:
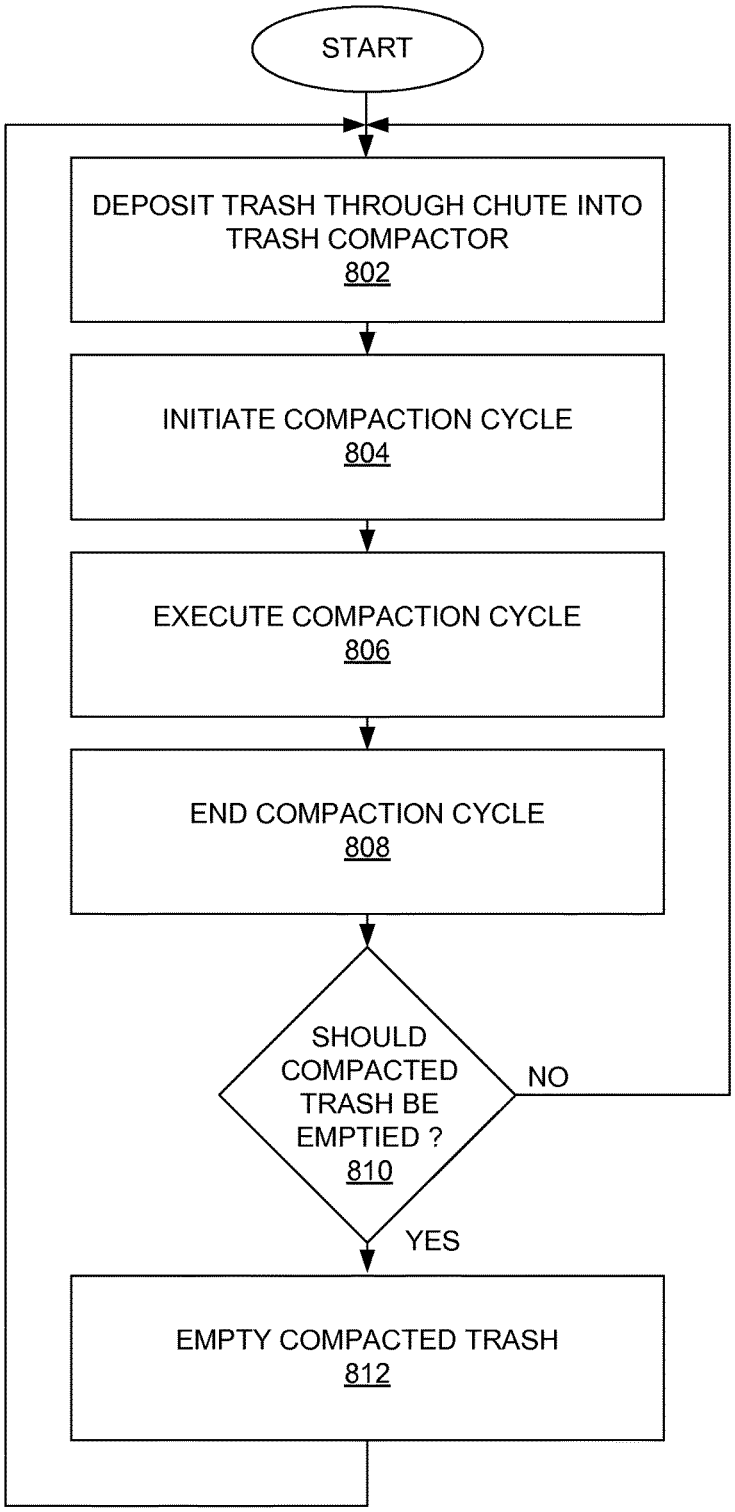
FIG. 8 shows a method of operating the trash compactor system, in accordance with an embodiment.

FIG. 8 shows a method of operating the trash compactor system, in accordance with an embodiment. In a step 802, a cabin attendant may approach the trash compactor system with some in-flight trash and press an OPEN DOOR button on the user interface 510, or manually open the side-loading flap 555 or hinged chute lid 655. After the flap 555 or chute lid 655 is open, the cabin attendant may deposit the trash through the chute 522 or 622 into the cylindrical storage chamber 524 or 624. Step 802 may be repeated until the cylindrical storage chamber 524 or 624 is full, or until there is no more in-flight trash, or the cabin attendant decides to compact the trash that has been collected in the cylindrical storage chamber 524 or 624 so far.

In a step 804, the flap 555 or chute lid 655 is manually closed and a COMPACT button on the user interface 510 is pressed. Alternatively, whether the cylindrical storage chamber 524 or 624 is full may be automatically detected, and a COMPACT cycle automatically initiated in response. In still another embodiment, a COMPACT command may be issued to the trash compactor system via a remote controller or computer over the galley data bus. For safety purposes, an interlock may prevent the trash compactor system from performing a compaction cycle unless or until the flap 555 or chute lid 655 is in a closed position.

In a step 806, the trash compactor system executes a compaction cycle. When the compaction cycle begins, the actuator 730 above the cylindrical storage chamber 524 or 624 pushes the trash downward within the cylindrical storage chamber 524 or 624 and thereby compacts the trash. The actuator 730 may be activated by the system controller's application of power to a solenoid to switch a four-way hydraulic control valve from a "retract" setting to an "extend" setting. The system controller may then cause power to be applied to the pump motor of the pump assembly 740 through the motor driver, for example in a waveform that drives a brushless DC motor. During operation of the trash compactor system, the pressure transducer may monitor the system pressure and report the monitored pressure values to the system controller.

In a step 808, the trash compactor system ends a compaction cycle. The actuator 730 returns to its inactive position above the cylindrical storage chamber 524 or 624 to once again provide unobstructed access to the cylindrical storage chamber 524 or 624 for inserting more trash or emptying the compacted trash. When the system controller determines that the system pressure has reached a predefined amount (e.g., 3000 psi), power to the coil of the four-way hydraulic control valve may be removed and a spring-return action of the valve may return to "retract." The actuator 730 may then be retracted and the ram sensor may be activated, signaling the system controller to stop the motor driver from operating the motor.

In a step 810, a determination is made regarding whether the compacted trash should be emptied. For example, whether the cylindrical storage chamber 524 or 624 is full may be automatically detected by a load or weight sensor of the cylindrical storage chamber 524 or 624. For example, the compacted trash may be determined ready to be emptied when the weight exceeds approximately 15 kg. Alternatively, the cabin attendant may determine that the compacted trash should be emptied. If the determination is made that the compacted trash does not need to be emptied, the method returns to step 802. If the determination is made that the compacted trash does need to be emptied, the method proceeds to step 812.

In a step 812, the compacted trash is emptied. The galley trolley or cart 441 is slid out from under the workdeck 410 to gain access to the cylindrical storage chamber 524 or 624. The cylindrical storage chamber 524 may then rotated outward into a trash-emptying position, or the cylindrical storage chamber 624 may be manually pulled out from the support assembly 660. The consumable trash container or liner may then be pulled out from the cylindrical storage chamber 524 or 624 and disposed of appropriately. A replacement empty consumable trash container or liner may then be inserted into the cylindrical storage chamber 524 or 624. The cylindrical storage chamber 524 or 624 may then be placed back into operational position, and the galley trolley 441 may then be returned to its original position under the workdeck 410. The method may then return to step 802.

The trash compactor system may be powered by 3-phase variable-frequency aircraft power or may be adapted to other input power sources. The trash compactor system may be independent of all other galley components and may easily be integrated into the structure of the galley work deck. Thus, the trash compactor system may be referred to as a vehicle integrated galley trash compactor (IGTC). The trash compactor system may reduce weight and cost and increase efficiency compared to prior systems. The trash compactor system may be designed as a highly-efficient galley-mounted built-in trash compaction system that fits into otherwise unused or inaccessible spaces, e.g., rear corners of a typical medium-to-large-size aircraft galley, thereby freeing up galley cart space which may be used for galley carts, replacing traditional galley-cart style legacy trash compactors. The trash compactor system may be used to compact any and all aircraft trash normally accumulated during in-flight meal, snack, and beverage services. In a preferred embodiment, the trash compactor system may weigh less than approximately 70 kg, and have a minimum mean time between failure of about 10,000 hours. Using an embodiment of the trash compactor system may free up as much as four standard trolley locations on an aircraft.

All references, including publications, patent applications, and patents, cited herein are hereby incorporated by reference to the same extent as if each reference were individually and specifically indicated to be incorporated by reference and were set forth in its entirety herein.

For the purposes of promoting an understanding of the principles of the invention, reference has been made to the embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The terminology used herein is for the purpose of describing the particular embodiments and is not intended to be limiting of exemplary embodiments of the invention.

The apparatus described herein may comprise a processor, a memory for storing program data to be executed by the processor, a permanent storage such as a disk drive, a communications port for handling communications with external devices, and user interface devices, including a display, keys, etc. When software modules are involved, these software modules may be stored as program instructions or computer readable code executable by the processor on a non-transitory computer-readable media such as read-only memory (ROM), random-access memory (RAM), CD-ROMs, DVDs, magnetic tapes, hard disks, floppy disks, and optical data storage devices. The computer readable recording media may also be distributed over network coupled computer systems so that the computer readable code is stored and executed in a distributed fashion. This media may be read by the computer, stored in the memory, and executed by the processor.

Also, using the disclosure herein, programmers of ordinary skill in the art to which the invention pertains may easily implement functional programs, codes, and code segments for making and using the invention.

The invention may be described in terms of functional block components and various processing steps. Such functional blocks may be realized by any number of hardware and/or software components configured to perform the specified functions. For example, the invention may employ various integrated circuit components, e.g., memory elements, processing elements, logic elements, look-up tables, and the like, which may carry out a variety of functions under the control of one or more microprocessors or other control devices. Similarly, where the elements of the invention are implemented using software programming or software elements, the invention may be implemented with any programming or scripting language such as C, C++, Java, assembler, or the like, with the various algorithms being implemented with any combination of data structures, objects, processes, routines or other programming elements. Functional aspects may be implemented in algorithms that execute on one or more processors. Furthermore, the invention may employ any number of conventional techniques for electronics configuration, signal processing and/or control, data processing and the like. Finally, the steps of all methods described herein may be performed in any suitable order unless otherwise indicated herein or otherwise clearly contradicted by context.

For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. The words "mechanism" and "element" are used broadly and are not limited to mechanical or physical embodiments, but may include software routines in conjunction with processors, etc.

The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those of ordinary skill in this art without departing from the spirit and scope of the invention as defined by the following claims. Therefore, the scope of the invention is defined not by the detailed description of the invention but by the following claims, and all differences within the scope will be construed as being included in the invention.

No item or component is essential to the practice of the invention unless the element is specifically described as "essential" or "critical". It will also be recognized that the terms "comprises," "comprising," "includes," "including," "has," and "having," as used herein, are specifically intended to be read as open-ended terms of art. The use of the terms "a" and "an" and "the" and similar referents in the context of describing the invention (especially in the context of the following claims) are to be construed to cover both the singular and the plural, unless the context clearly indicates otherwise. In addition, it should be understood that although the terms "first," "second," etc. may be used herein to describe various elements, these elements should not be limited by these terms, which are only used to distinguish one element from another. Furthermore, recitation of ranges of values herein are merely intended to serve as a shorthand method of referring individually to each separate value falling within the range, unless otherwise indicated herein, and each separate value is incorporated into the specification as if it were individually recited herein.

What is claimed is:

1. An aircraft galley trash compaction system comprising:

an aircraft galley having a workdeck;

a trash chute;

a compactor mechanism disposed above a level of the trash chute and above a level of the workdeck; and a storage chamber removably positioned below the compactor mechanism and below both the trash chute and the workdeck, the storage chamber vertically aligned with the compactor mechanism, the trash chute configured to channel trash disposed through an opening of the workdeck into an opening of the storage chamber, wherein an opening of the trash chute is at the opening of the workdeck and above a level of a top of the storage chamber, and wherein the opening of the trash chute is horizontally offset from the vertical alignment of the storage chamber and compactor mechanism.

2. The trash compaction system of claim 1, further comprising:

an electronic system controller that controls operation of the compactor mechanism; and a user interface which interfaces with the electronic system controller to initiate a compaction cycle upon a command input from an operator.

3. The trash compaction system of claim 2, wherein the storage chamber includes a weight sensor communicatively coupled with the electronic system controller, and wherein the electronic system controller activates operation of the compactor mechanism when a weight reading of the weight sensor exceeds a threshold value.

4. The trash compaction system of claim 2, wherein the storage chamber includes a pressure sensor communicatively coupled with the electronic system controller, and wherein the electronic system controller deactivates operation of the compactor mechanism according to a pressure reading of the pressure sensor exceeding a threshold value.

5. The trash compaction system of claim 2, wherein the electronic system controller includes a communications network interface, and wherein the electronic system controller initiates a compaction cycle in response to a command received over the communications network interface.

6. The trash compaction system of claim 1, wherein the storage chamber has a generally cylindrical shape oriented in a vertical direction.

7. The trash compaction system of claim 1, wherein the compactor mechanism comprises a hydraulic system including a hydraulic pump, a hydraulic reservoir, and a compactor actuator hydraulically driven to compact trash within the storage chamber.

8. The trash compaction system of claim 6, wherein the compactor actuator is constructed of aircraft alloy steel.

9. The trash compaction system of claim 6, wherein the hydraulic pump includes a brushless DC motor.

* * * * *